United States Patent [19]

Trexler

[11] 4,237,638

[45] Dec. 9, 1980

[54] BOX MAGAZINE REPLACEMENT KIT FOR BOLT ACTION RIFLES

[76] Inventor: Gene D. Trexler, 3115 Washington St., Allentown, Pa. 18104

[21] Appl. No.: 931,164

[22] Filed: Aug. 4, 1978

[51] Int. Cl.[3] ..... F41C 25/00
[52] U.S. Cl. ..... 42/6
[58] Field of Search ..... 42/6, 50, 18, 22

[56] References Cited

U.S. PATENT DOCUMENTS

| | | | |
|---|---|---|---|
| 1,044,983 | 11/1912 | Brown | 42/50 |
| 2,875,544 | 3/1959 | Kreiger | 42/50 |
| 2,997,803 | 8/1961 | Florence | 42/50 |
| 3,235,994 | 2/1966 | Grippo | 42/50 |
| 3,803,739 | 4/1974 | Haines et al. | 42/6 |
| 4,056,038 | 11/1977 | Rath | 42/50 |

FOREIGN PATENT DOCUMENTS

| | | | |
|---|---|---|---|
| 1014717 | 8/1952 | France | 42/50 |

*Primary Examiner*—Charles T. Jordan
*Attorney, Agent, or Firm*—Ruth Moyerman

[57] ABSTRACT

A two-part replacement magazine kit for rifles is disclosed. One part is a removable magazine chamber in which cartridges are intended to be inserted in stacked position. The magazine has a recess in the rear wall into which a detent portion of a latching means fits and thereby secures the magazine in the magazine housing.

A magazine housing forms a second part of the kit. The magazine housing includes, as a latching means, a detent which pivots by means of a horizontally positioned spring toward the recess in the magazine rear wall where it catches and holds the magazine. A finger piece at the other end of the detent extends below the housing. Forward pressure by the hunter's finger on the finger piece causes release of the magazine.

6 Claims, 5 Drawing Figures

BOX MAGAZINE REPLACEMENT KIT FOR BOLT ACTION RIFLES

BACKGROUND OF THE INVENTION

1. Field of the Invention

This invention relates to firearms and more particularly to drop floor plate, rearward, breech loading rifles.

2. Description of the Prior Art

Rifles on the market today, typified by the Remington 700 Series and others, are less than satisfactory because of the loading and unloading mechanism of the rifle. To load cartridges, they must be inserted one at a time. To remove unfired cartridges, the rifle includes a hinged floor plate which, when unlatched, drops open to permit removal of shells. A folded leaf spring, attached at its one end to the floor plate, is utilized to urge the shells upward in position to enter the firing chamber. The inconvenience of the latched drop floor plate is well known. Most of the time, and especially in cold winter and in the dark, shells easily slip through the fingers of the hunter, falling to the ground where they may be lost or damaged. To eliminate the deficiencies of the factory-supplied rifle, it has been proposed to substitute a magazine chamber which may be removed totally from the rifle and which contains the shells in stacked relationship, ready to be used upon reinsertion. Replacement kits such as U.S. Pat. No. 3,803,739 to Haines, et al and U.S. Pat. No. 2,997,803 to Florence enable the owner or a gunsmith to make alterations in the stock-supplied rifles. The central problem with replacement kits relates to the latching means to secure the magazine within the rifle. The Haines patent itself points out this problem in the background.

The Haines solution requires the hunter to use two hands, one to push upward and hold a finger piece in this position to cause a latch pin to raise. Thereafter, presumably the other hand can be utilized to slide the magazine rearwardly to disengage it from a lip and groove whereupon the assembly will drop out of the rifle.

Florence utilizes a spring also, but Florence provides a finger release which is operable within the trigger bow. A dangerous situation might result here as the hunter's trigger finger may accidentally trigger the release while firing or firing the round in the chamber while unloading. Furthermore, this reference uses an externally mounted spring pin which both detracts from the rifle's appearance and affords opportunity to admit grease or grime to the spring mechanism. Also, a backward sliding of the magazine to disengage it from the rifle is also required.

Other latching mechanisms are shown in U.S. Pat. Nos. 2,642,688 and 2,657,489 but each of these latches is also externally mounted and thereby gives a "lump" appearance to the rifle stock.

SUMMARY OF THE INVENTION

The aforementioned prior art problems are solved by the magazine replacement kit of this invention which includes a novel latching means to secure the magazine within the housing.

In this invention, two separate parts are supplied as the kit. One part is a magazine chamber in which cartridges are contained in stacked relationship within the chamber. The cartridges are urged upwardly to be in position for entering the firing chamber by a leaf spring within the bottom of the magazine. The rearward outer wall of the magazine chamber contains a recess or groove to receive a detent part of a latching means.

The kit also includes, as a second part, a magazine housing section. The housing has an integral floor plate which is intended as a replacement part for the floor plate of existing bolt action rifles. The floor plate ends in tabs forward and rearward, each with a hole in perfect registration with the holes already in the rifle stock to receive the screws bolting the existing floor plate. The housing also includes a walled portion, generally parallelpipedal in shape, designed to receive the magazine. The height of the wall prevents forward tilting of the magazine and, therefore, a magazine front lock common in the prior art may be eliminated. A trigger guard bow is also part of the housing. In the device of this invention, the rearward portion of the housing wall contains a recess within which a latching mechanism is positioned. The latching mechanism functions to hold the magazine within the housing. It includes a detent, positioned vertically and pivotally, within the recess. A small coil spring is positioned horizontally above the detent pivot point between the rear wall and the detent. This spring will thus operate to urge the detent forward, causing it to catch in the magazine recess and latch the magazine in the housing. The other end of the detent extends downward below the floor plate forward of the trigger guard and ends in a finger piece. The latch is operated by pressing forward on the finger piece, preferably with the hunter's trigger finger. A single, removable pin secures the detent and provides the pivot point.

To convert an existing rifle, no special tools or skills are required. The user may simply unscrew the existing floor plate where it is bolted through the tab sections, remove the old floor plate with its combination trigger guard, and insert and re-bolt the new housing. Loaded cartridges are kept in the magazine and to use, the hunter simply inserts the magazine through the hole in the floor plate into the rifle where the spring of the latching mechanism automatically urges the detent forward to catch and hold the magazine in place. To unload the rifle the hunter, using only one finger, activates the detent by pressing the finger piece forward, thereby releasing the other end of the detent from the groove in the magazine whereupon the magazine will drop out of the rifle by its own weight.

It is, therefore, an object of this invention to provide a magazine kit to replace the floor portion of bolt action rifles and, thereby, provide a more satisfactory cartridge loading/unloading method.

It is also an object of this invention to provide a magazine replacement kit which the ordinary person, without special skills or tools, may utilize.

It is also an object of this invention to provide a universal replacement kit suitable for use in a multiplicity of different type rifles.

It is again an object of this invention to provide a magazine replacement kit which is simple to use, requiring only one finger to activate.

It is a further object of this invention to achieve the aforementioned objects with a magazine replacement kit which is safe as well as convenient to use.

These and other objects will be more readily ascertainable to one skilled in the art from a consideration of the accompanying drawings and exemplary embodiments.

DETAILED DESCRIPTION

Figures 1, 2, 3, 4, 5:
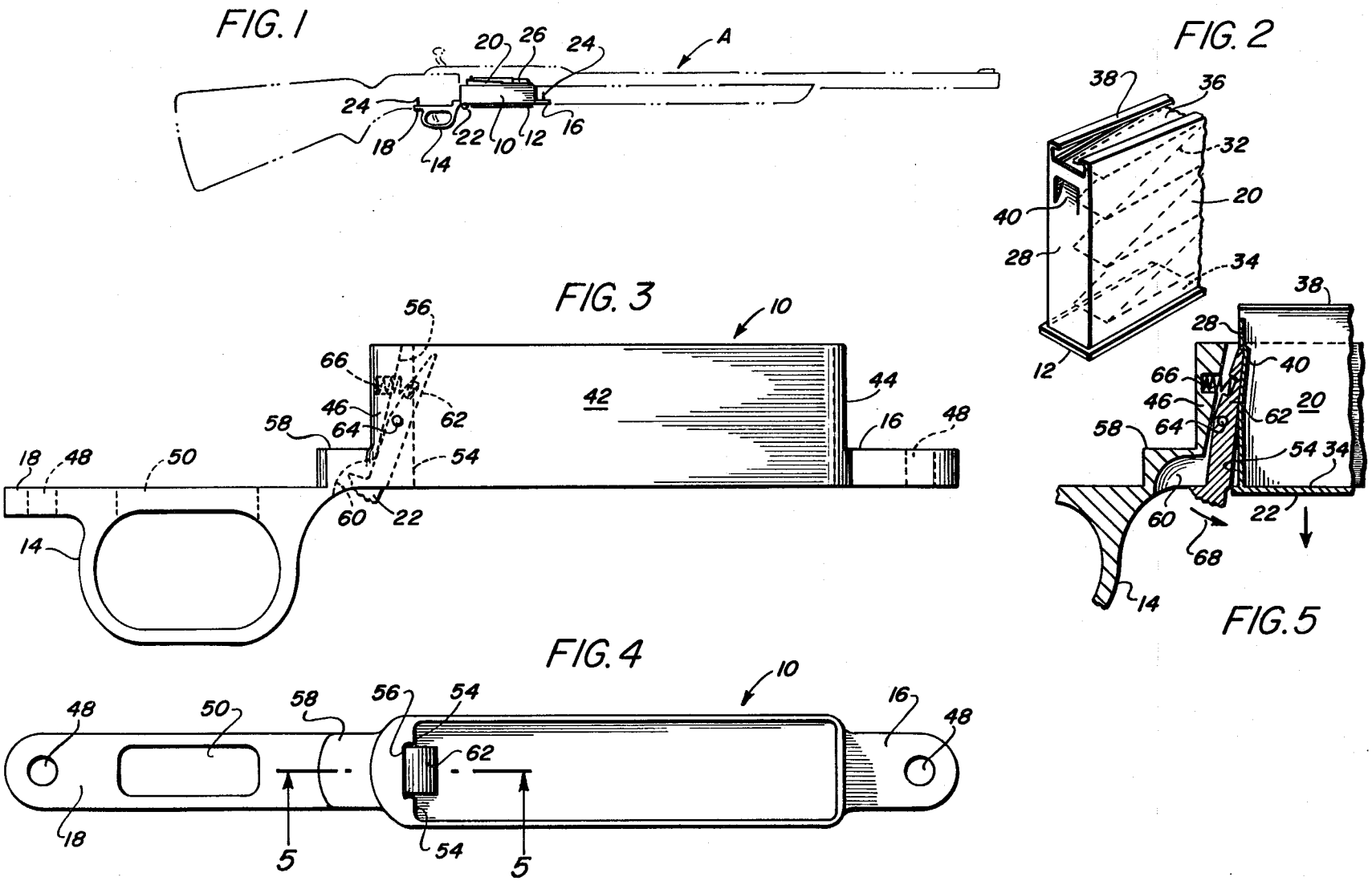
FIG. 1 shows a rifle with the device of this invention inserted in place.
FIG. 2 is a fragmentary isometric of the magazine portion of the device.
FIG. 3 shows a side elevation of the magazine housing of this invention with the latching means shown in phantom.
FIG. 4 is a top elevation of the magazine housing.
FIG. 5 shows a cross section close-up of the latching means including a partial section of the magazine.

Referring now to the drawing wherein like numbers refer to like parts, FIG. 1 shows a rifle, generally A, with the device of this invention mounted in place as it would be in use. Magazine housing 10 includes floor plate section 12, trigger guard 14, front tab 16 and rear tab 18. A very small portion of the magazine section itself may also be seen and this includes side walls 20 and finger piece 22. Also visible in FIG. 1 are screws 24 by which the magazine kit is held within the rifle. In as much as the view in FIG. 1 shows a loaded rifle, a cartridge 26 is also visible.

Referring now to FIG. 2, more details of the magazine itself are visible. The magazine includes side wall 20, rear wall 28 and front wall 30. Leaf spring 32, shown in phantom in FIG. 2, rests in the extended position it would assume in an empty magazine. Leaf spring 32 is attached at its one end to magazine floor 34 and at its other end to follower plate 36 upon which the cartridges rest. Cartridges are placed in the magazine from the top in stacked relationship and leaf spring 32 operates to urge the cartridges upward to be in position to enter the firing chamber. Side walls 20 are shown curved at their upper edge 38 to better hold the cartridges in place in the magazine. A very important aspect of the device of this invention relates to recess 40 shown in rear wall 28. Recess 40 is of a size and shape to receive the detent of a latching means to be discussed in more detail in reference to subsequent Figures.

Referring now to FIG. 3, a side elevation of magazine housing 10 is shown. The magazine housing includes side walls 42, trigger guard 14, front tab 16 and rear tab 18. The housing also includes front wall 44 and rear wall 46. Apertures 48 in front tab 16 and rear tab 18 are shown in phantom. These apertures are preferably drilled holes which are positioned to be in perfect registration with holes previously drilled in the manufacture of the rifle itself, thereby enabling the kit to be installed without major alterations of the rifle stock. Trigger guard 14 includes an opening 50, also shown in phantom in FIG. 3. This opening is necessary to enable the fitting of the trigger guard over the rifle trigger itself. Housing rear wall 46 contains a recess as may be noted by reference to the front portion of the wall 54 shown in phantom in FIG. 3. The recess narrows considerably at the top of the rear wall as shown at 56. Housing rear wall 46 also contains shoulder section 58 which is preferably rounded for appearance sake. Shoulder section 58 contains recess 60 of a size and shape to accommodate a finger piece 22. Also shown in phantom in FIG. 3 is detent 62. Detent 62 is attached to housing 10 through rear wall 46 by removable pin 64. Spring 66 rests longitudinally within housing 10, one end resting against magazine rear wall 46 and the other end embedded in detent 62.

Referring now to FIG. 4, a top elevation of magazine housing 10 is shown. Front tab 16, rear tab 18, apertures 48 and trigger guard opening 50 are more readily discernable in this Figure. FIG. 4 also shows rear wall 46 including shoulder 58 in more detail. It is readily apparent in FIG. 4 that rear wall 46 is much thicker at the top of the magazine housing than at the bottom. Detent 62 is only visible on its top edge, but FIG. 4 gives a better illustration of the width of the detent in this preferred embodiment. In as much as in FIG. 4, magazine housing 10 is shown without the magazine itself, detent 62 will naturally project further forward than it will when the magazine is in place. This is clearly shown in FIG. 4. Referring back to FIG. 3, it may be seen that without the magazine, the detent rests with its lower edge against shoulder 58 near finger piece 22. It is the resting of the detent against the inner edge of shoulder 58 that determines how far the detent will advance at its upper end. The detent pivots around pin 64.

Referring now to FIG. 5, more details of detent 62 are now visible. FIG. 5 is a cross section taken through lines 5—5 of FIG. 4, but with the important exception that in FIG. 5, the magazine is shown inserted in the housing whereas in FIG. 4, no magazine was present. Thus it may be seen in FIG. 5 that the forward tilt of detent 62 is arrested by its resting against magazine rear wall 28 in recess 40. Directional arrow 68 shows the direction detent 62 must be pushed to release the magazine. Finger piece 22 is shown generally triangular in cross section with a serrated rearward face. The shape of finger piece 22, in conjunction with recess 60, is designed to easily accommodate either the thumb or most probably the side of the index finger of the hunter. Pressing finger piece 22 in the direction shown by arrow 68 easily disengages the upper end of the detent from recess 40, thus allowing the magazine to drop from the housing of its own weight.

To utilize the magazine replacement kit of this invention, no special tools or skills are required. The user simply unscrews the existing floor plate from his rifle and inserts magazine housing 10, securing it with two screws. Cartridges are inserted in the magazine and the magazine itself is shoved into the rifle into magazine housing 10 from the bottom. The latching means will automatically press against the magazine, holding it in place. To release the magazine, pressure from one finger on the finger piece of the detent will cause the magazine to drop from the rifle conveniently and safely into the hunter's hand.

It may be seen that the latching means of this invention is such that, in the preferred embodiment illustrated in the drawing, it is unnecessary to have the tongue and groove latching of the magazine at the forward end of the housing such as is common in the prior art devices.

There are many variations which may be practiced within the scope of this invention. For example, the magazine kit is designed for general use in bolt action rifles. The device illustrated in the drawing is intended to be fit on a Remington #700 rifle. This same kit is also adaptable to many other rifles on the market such as Winchester #70 and Ruger #77, etc. In some instances, a very slight modification of the size or shape of the floor plate of magazine housing 10 may be necessary to accommodate different rifle models.

It is, however, the latching means by which this rifle kit is superior to that of the prior art. The parts are easily manufactured. They may most conveniently be factory assembled, but if it is necessary to clean or repair the latching means, one simply removes pin 64 which will cause the detent 62 and spring 66 to be free of the housing. The latching means of this invention is not only easy to use, but it is inconspicuous in size. Shoulder 58 is quite small, easily fitting within the allowable space in the rifle stock.

The magazine itself is also of simple construction and the recess necessary to accommodate the detent is quite shallow so that it is unnecessary to use a specially thickened magazine rear wall. Thus, the magazine itself is kept simple and inexpensive to manufacture.

The advantages of the device of this invention over prior art replacement magazines lies in the simplicity of construction, superiority of function and streamlined looks. A hunter, with the use of this replacement kit, may conveniently and inexpensively replace the clumsy individual loading and unloading of cartridges into the rifle with its inherent inconvenience and danger. The loaded magazine may now be kept in the hunter's pocket and inserted in the rifle only just prior to its use. Cartridges will not be lost or damaged and inconvenience will be lessened.

Having thus described and illustrated this invention, it is not intended that such description limit the scope of this invention, but rather that this invention be limited only by reasonable interpretation of the apended claims.

What is claimed is:

1. A replacement magazine kit for bolt action rifles comprising:

(a) a generally parallelpipedal magazine including floor and side walls, front and back walls, and opened sufficiently at the top to permit insertion of rifle cartridges therein in stacked relationship, said magazine outer back wall including a recess portion above its horizontal mid point to receive a latch detent;

(b) a magazine housing including:

(i) a housing floor plate portion with an opening of sufficient size to allow insertion therein of said magazine, said housing plate extending forwardly from said opening and ending in tab means whereby said housing may be secured to said rifle at its forward end;

(ii) a trigger guard bow, integral with said floor plate and extending rearwardly therefrom, said trigger guard ending in tab means whereby said housing may be secured to said rifle at its rearward end;

(iii) a generally parallelpipedal wall portion including side walls and a front and a back wall with an external shoulder, said shoulder underside including a recess portion to accommodate a magazine latching detent finger piece, said wall inner dimensions being of a size and shape to accommodate said magazine and said housing rear wall being recessed to provide an opening to permit a spring-urged detent to be inserted therein;

(iv) as a magazine latching means a detent, pivotally mounted, positioned generally vertically within said housing rear wall recess, the upper end of said detent being adapted to catch and rest within said magazine recess and said other end of which terminates in a finger piece projecting below said floor plate; and, (v) spring means positioned horizontally between said housing rear wall and said detent above said detent pivot point to urge said detent upper end toward said magazine recess, said spring being mounted within recesses in both said wall and said detent.

2. The magazine replacement kit of claim 1 in which said spring is a coil spring, one end of which is recessed within the magazine housing rear wall and the other end of which is recessed within the detent.

3. The magazine replacement kit of claim 1 wherein said detent is secured to said magazine housing by a removable pin inserted transversely through said housing rear wall and said detent.

4. The magazine replacement kit of claim 1 wherein said detent finger piece is generally triangular in cross section.

5. The magazine replacement kit of claim 4 wherein said finger piece is serrated on its rearward face.

6. The magazine replacement kit of claim 1 wherein said detent has been tapered above its pivot point on the face adjacent the housing rear wall.

* * * * *